US009366036B2

(12) United States Patent
Pervan

(10) Patent No.: US 9,366,036 B2
(45) Date of Patent: Jun. 14, 2016

(54) MECHANICAL LOCKING SYSTEM FOR FLOOR PANELS

(71) Applicant: CERALOC INNOVATION AB, Viken (SE)

(72) Inventor: Darko Pervan, Viken (SE)

(73) Assignee: CERALOC INNOVATION AB, Viken (SE)

( * ) Notice: Subject to any disclaimer, the term of this patent is extended or adjusted under 35 U.S.C. 154(b) by 0 days.

(21) Appl. No.: 14/646,567

(22) PCT Filed: Nov. 21, 2013

(86) PCT No.: PCT/SE2013/051374

§ 371 (c)(1),
(2) Date: May 21, 2015

(87) PCT Pub. No.: WO2014/081382

PCT Pub. Date: May 30, 2014

(65) Prior Publication Data

US 2015/0300029 A1 Oct. 22, 2015

(30) Foreign Application Priority Data

Nov. 22, 2012 (SE) ..... 1251322

(51) Int. Cl.
*E04F 15/02* (2006.01)
*E04B 5/02* (2006.01)

(52) U.S. Cl.
CPC ..... *E04F 15/02038* (2013.01); *E04B 5/02* (2013.01); *E04F 2201/0146* (2013.01); *E04F 2201/0552* (2013.01)

(58) Field of Classification Search
CPC ..... E04F 15/02038; E04F 2201/0146; E04F 2201/0552; E04B 5/02
See application file for complete search history.

(56) References Cited

U.S. PATENT DOCUMENTS

| | | | |
|---|---|---|---|
| 87,853 | A | 3/1869 | Kappes |
| 108,068 | A | 10/1870 | Utley |
| 124,228 | A | 3/1872 | Stuart |
| 213,740 | A | 4/1879 | Conner |
| 274,354 | A | 3/1883 | McCarthy et al. |
| 316,176 | A | 4/1885 | Ransom |

(Continued)

FOREIGN PATENT DOCUMENTS

| | | | |
|---|---|---|---|
| CA | 2456513 | A1 | 2/2003 |
| CN | 201588375 | U | 9/2010 |

(Continued)

OTHER PUBLICATIONS

U.S. Appl. No. 14/701,959, Pervan, et al.

(Continued)

*Primary Examiner* — Patrick Maestri
(74) *Attorney, Agent, or Firm* — Buchanan Ingersoll & Rooney P.C.

(57) ABSTRACT

Floor panels provided with a mechanical locking system comprising a separate material in order to reduce snapping resistance during vertical displacement. For example, a separate flexible tongue, the flexible tongue including an inner part, which is connected to a holding groove at a second edge, and an outer flexible snap tab that extends upwardly and in the connected state into a cavity under a protruding tongue for locking a first and a second floor panel to each other in a vertical direction.

18 Claims, 5 Drawing Sheets

(56) References Cited

U.S. PATENT DOCUMENTS

| | | | |
|---|---|---|---|
| 634,581 | A | 10/1899 | Miller |
| 861,911 | A | 7/1907 | Stewart |
| 1,194,636 | A | 8/1916 | Joy |
| 1,723,306 | A | 8/1929 | Sipe |
| 1,743,492 | A | 1/1930 | Sipe |
| 1,809,393 | A | 6/1931 | Rockwell |
| 1,902,716 | A | 3/1933 | Newton |
| 2,026,511 | A | 12/1935 | Storm |
| 2,204,675 | A | 6/1940 | Grunert |
| 2,266,464 | A | 12/1941 | Kraft |
| 2,277,758 | A | 3/1942 | Hawkins |
| 2,430,200 | A | 11/1947 | Wilson |
| 2,596,280 | A | 5/1952 | Nystrom |
| 2,732,706 | A | 1/1956 | Friedman |
| 2,740,167 | A | 4/1956 | Rowley |
| 2,858,584 | A | 11/1958 | Gaines |
| 2,863,185 | A | 12/1958 | Riedi |
| 2,865,058 | A | 12/1958 | Andersson |
| 2,889,016 | A | 6/1959 | Warren |
| 3,023,681 | A | 3/1962 | Worson |
| 3,077,703 | A | 2/1963 | Bergstrom |
| 3,099,110 | A | 7/1963 | Spaight |
| 3,147,522 | A | 9/1964 | Schumm |
| 3,271,787 | A | 9/1966 | Clary |
| 3,325,585 | A | 6/1967 | Brenneman |
| 3,331,180 | A | 7/1967 | Vissing et al. |
| 3,378,958 | A | 4/1968 | Parks et al. |
| 3,396,640 | A | 8/1968 | Fujihara |
| 3,512,324 | A | 5/1970 | Reed |
| 3,517,927 | A | 6/1970 | Kennel |
| 3,526,071 | A | 9/1970 | Watanabe |
| 3,535,844 | A | 10/1970 | Glaros |
| 3,572,224 | A | 3/1971 | Perry |
| 3,579,941 | A | 5/1971 | Tibbals |
| 3,720,027 | A | 3/1973 | Christensen |
| 3,722,379 | A | 3/1973 | Koester |
| 3,731,445 | A | 5/1973 | Hoffmann et al. |
| 3,742,669 | A | 7/1973 | Mansfeld |
| 3,760,547 | A | 9/1973 | Brenneman |
| 3,760,548 | A | 9/1973 | Sauer et al. |
| 3,778,954 | A | 12/1973 | Meserole |
| 3,849,235 | A | 11/1974 | Gwynne |
| 3,919,820 | A | 11/1975 | Green |
| 3,950,915 | A | 4/1976 | Cole |
| 3,994,609 | A | 11/1976 | Puccio |
| 4,007,994 | A | 2/1977 | Brown |
| 4,030,852 | A | 6/1977 | Hein |
| 4,037,377 | A | 7/1977 | Howell et al. |
| 4,041,665 | A | 8/1977 | de Munck |
| 4,064,571 | A | 12/1977 | Phipps |
| 4,080,086 | A | 3/1978 | Watson |
| 4,082,129 | A | 4/1978 | Morelock |
| 4,100,710 | A | 7/1978 | Kowallik |
| 4,104,840 | A | 8/1978 | Heintz et al. |
| 4,107,892 | A | 8/1978 | Bellem |
| 4,113,399 | A | 9/1978 | Hansen, Sr. et al. |
| 4,169,688 | A | 10/1979 | Toshio |
| RE30,154 | E | 11/1979 | Jarvis |
| 4,196,554 | A | 4/1980 | Anderson |
| 4,227,430 | A | 10/1980 | Jansson et al. |
| 4,299,070 | A | 11/1981 | Oltmanns |
| 4,304,083 | A | 12/1981 | Anderson |
| 4,426,820 | A | 1/1984 | Terbrack |
| 4,447,172 | A | 5/1984 | Galbreath |
| 4,512,131 | A | 4/1985 | Laramore |
| 4,599,841 | A | 7/1986 | Haid |
| 4,648,165 | A | 3/1987 | Whitehorne |
| 4,819,932 | A | 4/1989 | Trotter, Jr. |
| 5,007,222 | A | 4/1991 | Raymond |
| 5,026,112 | A | 6/1991 | Rice |
| 5,071,282 | A | 12/1991 | Brown |
| 5,135,597 | A | 8/1992 | Barker |
| 5,148,850 | A | 9/1992 | Urbanick |
| 5,173,012 | A | 12/1992 | Ortwein et al. |
| 5,182,892 | A | 2/1993 | Chase |
| 5,247,773 | A | 9/1993 | Weir |
| 5,272,850 | A | 12/1993 | Mysliwiec et al. |
| 5,274,979 | A | 1/1994 | Tsai |
| 5,295,341 | A | 3/1994 | Kajiwara |
| 5,344,700 | A | 9/1994 | McGath et al. |
| 5,348,778 | A | 9/1994 | Knipp et al. |
| 5,373,674 | A | 12/1994 | Winter, IV |
| 5,465,546 | A | 11/1995 | Buse |
| 5,485,702 | A | 1/1996 | Sholton |
| 5,502,939 | A | 4/1996 | Zadok et al. |
| 5,548,937 | A | 8/1996 | Shimonohara |
| 5,577,357 | A | 11/1996 | Civelli |
| 5,598,682 | A | 2/1997 | Haughian |
| 5,618,602 | A | 4/1997 | Nelson |
| 5,634,309 | A | 6/1997 | Polen |
| 5,658,086 | A | 8/1997 | Brokaw et al. |
| 5,694,730 | A | 12/1997 | Del Rincon et al. |
| 5,755,068 | A | 5/1998 | Ormiston |
| 5,860,267 | A | 1/1999 | Pervan |
| 5,899,038 | A | 5/1999 | Stroppiana |
| 5,910,084 | A | 6/1999 | Koike |
| 5,950,389 | A | 9/1999 | Porter |
| 5,970,675 | A | 10/1999 | Schray |
| 6,006,486 | A | 12/1999 | Moriau |
| 6,029,416 | A | 2/2000 | Andersson |
| 6,052,960 | A | 4/2000 | Yonemura |
| 6,065,262 | A | 5/2000 | Motta |
| 6,173,548 | B1 | 1/2001 | Hamar et al. |
| 6,182,410 | B1 | 2/2001 | Pervan |
| 6,203,653 | B1 | 3/2001 | Seidner |
| 6,254,301 | B1 | 7/2001 | Hatch |
| 6,295,779 | B1 | 10/2001 | Canfield |
| 6,314,701 | B1 | 11/2001 | Meyerson |
| 6,332,733 | B1 | 12/2001 | Hamberger |
| 6,339,908 | B1 | 1/2002 | Chuang |
| 6,345,481 | B1 | 2/2002 | Nelson |
| 6,358,352 | B1 | 3/2002 | Schmidt |
| 6,363,677 | B1 | 4/2002 | Chen et al. |
| 6,385,936 | B1 | 5/2002 | Schneider |
| 6,418,683 | B1 | 7/2002 | Martensson et al. |
| 6,446,413 | B1 | 9/2002 | Gruber |
| 6,449,918 | B1 | 9/2002 | Nelson |
| 6,450,235 | B1 | 9/2002 | Lee |
| 6,490,836 | B1 | 12/2002 | Moriau et al. |
| 6,505,452 | B1 | 1/2003 | Hannig |
| 6,546,691 | B2 | 4/2003 | Leopolder |
| 6,553,724 | B1 | 4/2003 | Bigler |
| 6,576,079 | B1 | 6/2003 | Kai |
| 6,584,747 | B2 | 7/2003 | Kettler et al. |
| 6,591,568 | B1 | 7/2003 | Pålsson |
| 6,601,359 | B2 | 8/2003 | Olofsson |
| 6,617,009 | B1 | 9/2003 | Chen et al. |
| 6,647,689 | B2 | 11/2003 | Pletzer et al. |
| 6,647,690 | B1 | 11/2003 | Martensson |
| 6,651,400 | B1 | 11/2003 | Murphy |
| 6,670,019 | B2 | 12/2003 | Andersson |
| 6,681,820 | B2 | 1/2004 | Olofsson |
| 6,685,391 | B1 | 2/2004 | Gideon |
| 6,729,091 | B1 | 5/2004 | Martensson |
| 6,763,643 | B1 | 7/2004 | Martensson |
| 6,766,622 | B1 | 7/2004 | Thiers |
| 6,769,219 | B2 | 8/2004 | Schwitte et al. |
| 6,769,835 | B2 | 8/2004 | Stridsman |
| 6,802,166 | B1 | 10/2004 | Gerhard |
| 6,804,926 | B1 | 10/2004 | Eisermann |
| 6,808,777 | B2 | 10/2004 | Andersson et al. |
| 6,854,235 | B2 | 2/2005 | Martensson |
| 6,862,857 | B2 | 3/2005 | Tychsen |
| 6,865,855 | B2 | 3/2005 | Knauseder |
| 6,874,291 | B1 | 4/2005 | Weber |
| 6,880,307 | B2 | 4/2005 | Schwitte et al. |
| 6,948,716 | B2 | 9/2005 | Drouin |
| 7,021,019 | B2 | 4/2006 | Knauseder |
| 7,040,068 | B2 | 5/2006 | Moriau et al. |
| 7,051,486 | B2 | 5/2006 | Pervan |
| 7,108,031 | B1 | 9/2006 | Secrest |
| 7,121,058 | B2 | 10/2006 | Pålsson |
| 7,152,383 | B1 | 12/2006 | Wilkinson et al. |
| 7,188,456 | B2 | 3/2007 | Knauseder |

(56) References Cited

U.S. PATENT DOCUMENTS 7,219,392 B2 5/2007 Mullet et al.
7,251,916 B2 8/2007 Konzelmann et al.
7,257,926 B1 8/2007 Kirby
7,337,588 B1 3/2008 Moebus
7,377,081 B2 5/2008 Ruhdorfer
7,451,578 B2 11/2008 Hannig
7,454,875 B2 11/2008 Pervan et al.
7,516,588 B2 4/2009 Pervan
7,517,427 B2 4/2009 Sjoberg et al.
7,533,500 B2 5/2009 Morton et al.
7,556,849 B2 7/2009 Thompson et al.
7,568,322 B2 8/2009 Pervan
7,584,583 B2 9/2009 Bergelin et al.
7,614,197 B2 11/2009 Nelson
7,617,651 B2 11/2009 Grafenauer
7,621,092 B2 11/2009 Groeke et al.
7,634,884 B2 12/2009 Pervan
7,637,068 B2 12/2009 Pervan
7,644,553 B2 1/2010 Knauseder
7,654,055 B2 2/2010 Ricker
7,677,005 B2 3/2010 Pervan
7,716,889 B2 5/2010 Pervan
7,721,503 B2 5/2010 Pervan et al.
7,726,088 B2 6/2010 Muehlebach
7,757,452 B2 7/2010 Pervan
7,802,411 B2 9/2010 Pervan
7,806,624 B2 10/2010 McLean et al.
7,841,144 B2 11/2010 Pervan et al.
7,841,145 B2 11/2010 Pervan et al.
7,841,150 B2 11/2010 Pervan
7,856,789 B2 12/2010 Eisermann
7,861,482 B2 1/2011 Pervan et al.
7,866,110 B2 1/2011 Pervan
7,908,815 B2 3/2011 Pervan et al.
7,908,816 B2 3/2011 Grafenauer
7,930,862 B2 4/2011 Bergelin et al.
7,954,295 B2 6/2011 Pervan
7,980,039 B2 7/2011 Groeke
7,980,041 B2 7/2011 Pervan
8,006,458 B1 8/2011 Olofsson et al.
8,033,074 B2 10/2011 Pervan
8,042,311 B2 10/2011 Pervan
8,061,104 B2 11/2011 Pervan
8,079,196 B2 12/2011 Pervan
8,112,967 B2 2/2012 Pervan et al.
8,171,692 B2 5/2012 Pervan
8,181,416 B2 5/2012 Pervan et al.
8,191,334 B2 6/2012 Braun
8,234,830 B2 8/2012 Pervan et al.
8,245,478 B2 8/2012 Bergelin
8,281,549 B2 10/2012 Du
8,302,367 B2 11/2012 Schulte
8,336,272 B2 12/2012 Prager et al.
8,341,914 B2 1/2013 Pervan et al.
8,341,915 B2 1/2013 Pervan et al.
8,353,140 B2 1/2013 Pervan et al.
8,359,805 B2 1/2013 Pervan et al.
8,381,477 B2 2/2013 Pervan et al.
8,387,327 B2 3/2013 Pervan
8,448,402 B2 5/2013 Pervan et al.
8,499,521 B2 8/2013 Pervan et al.
8,505,257 B2 8/2013 Boo et al.
8,511,031 B2 8/2013 Bergelin et al.
8,528,289 B2 9/2013 Pervan et al.
8,544,230 B2 10/2013 Pervan
8,544,234 B2 10/2013 Pervan et al.
8,572,922 B2 11/2013 Pervan
8,578,675 B2 11/2013 Palsson et al.
8,596,013 B2 12/2013 Boo
8,615,952 B2 12/2013 Engström
8,627,862 B2 1/2014 Pervan et al.
8,631,623 B2 1/2014 Engström
8,640,424 B2 2/2014 Pervan et al.
8,650,826 B2 * 2/2014 Pervan ..... E04F 15/02038 52/582.1
8,677,714 B2 3/2014 Pervan
8,689,512 B2 4/2014 Pervan
8,701,368 B2 4/2014 Vermeulen
8,707,650 B2 4/2014 Pervan
8,713,886 B2 5/2014 Boo et al.
8,733,065 B2 5/2014 Pervan
8,733,410 B2 5/2014 Pervan
8,763,341 B2 7/2014 Pervan
8,769,905 B2 7/2014 Pervan
8,776,473 B2 7/2014 Pervan et al.
8,844,236 B2 9/2014 Pervan et al.
8,857,126 B2 10/2014 Pervan et al.
8,869,485 B2 10/2014 Pervan
8,887,468 B2 11/2014 Hakansson et al.
8,898,988 B2 12/2014 Pervan
8,925,274 B2 1/2015 Darko et al.
8,938,929 B2 1/2015 Engström
8,959,866 B2 2/2015 Pervan
9,027,306 B2 5/2015 Pervan
9,051,738 B2 6/2015 Pervan et al.
9,068,360 B2 6/2015 Darko
9,194,134 B2 11/2015 Nygren et al.
2001/0024707 A1 9/2001 Andersson et al.
2002/0031646 A1 3/2002 Chen et al.
2002/0069611 A1 6/2002 Leopolder
2002/0092263 A1 7/2002 Schulte
2002/0170258 A1 11/2002 Schwitte et al.
2002/0170259 A1 11/2002 Ferris
2002/0178674 A1 12/2002 Pervan
2002/0178680 A1 12/2002 Martensson
2002/0189190 A1 12/2002 Charmat et al.
2002/0194807 A1 12/2002 Nelson et al.
2003/0009971 A1 1/2003 Palmberg
2003/0024199 A1 2/2003 Pervan et al.
2003/0037504 A1 2/2003 Schwitte et al.
2003/0084636 A1 5/2003 Pervan
2003/0094230 A1 5/2003 Sjoberg
2003/0101681 A1 6/2003 Tychsen
2003/0145549 A1 8/2003 Palsson et al.
2003/0180091 A1 9/2003 Stridsman
2003/0188504 A1 10/2003 Eisermann Ralf
2003/0196405 A1 10/2003 Pervan
2004/0016196 A1 1/2004 Pervan
2004/0031227 A1 2/2004 Knauseder
2004/0049999 A1 3/2004 Krieger
2004/0060255 A1 4/2004 Knauseder
2004/0068954 A1 4/2004 Martensson
2004/0123548 A1 7/2004 Gimpel et al.
2004/0128934 A1 7/2004 Hecht
2004/0139676 A1 7/2004 Knauseder
2004/0139678 A1 7/2004 Pervan
2004/0159066 A1 8/2004 Thiers et al.
2004/0168392 A1 9/2004 Konzelmann et al.
2004/0177584 A1 9/2004 Pervan
2004/0182033 A1 9/2004 Wernersson
2004/0182036 A1 9/2004 Sjoberg et al.
2004/0200175 A1 10/2004 Weber
2004/0211143 A1 10/2004 Hannig
2004/0244325 A1 12/2004 Nelson
2004/0250492 A1 12/2004 Becker
2004/0261348 A1 12/2004 Vulin
2005/0003132 A1 1/2005 Blix et al.
2005/0028474 A1 2/2005 Kim
2005/0050827 A1 3/2005 Schitter
2005/0160694 A1 7/2005 Pervan
2005/0166514 A1 8/2005 Pervan
2005/0205161 A1 9/2005 Lewark
2005/0210810 A1 9/2005 Pervan
2005/0235593 A1 10/2005 Hecht
2005/0252130 A1 11/2005 Martensson
2005/0268570 A2 12/2005 Pervan
2006/0053724 A1 3/2006 Braun et al.
2006/0070333 A1 4/2006 Pervan
2006/0101769 A1 5/2006 Pervan
2006/0156670 A1 7/2006 Knauseder
2006/0174577 A1 8/2006 O'Neil
2006/0179754 A1 8/2006 Yang
2006/0236642 A1 10/2006 Pervan
2006/0260254 A1 11/2006 Pervan et al.

(56) References Cited

U.S. PATENT DOCUMENTS

2006/0272262 A1 12/2006 Pomberger
2007/0006543 A1 1/2007 Engström
2007/0011981 A1 1/2007 Eiserman
2007/0028547 A1 2/2007 Grafenauer
2007/0065293 A1 3/2007 Hannig
2007/0108679 A1 5/2007 Grothaus
2007/0151189 A1 7/2007 Yang et al.
2007/0175156 A1 8/2007 Pervan et al.
2007/0193178 A1 8/2007 Groeke et al.
2007/0209736 A1 9/2007 Deringor et al.
2007/0214741 A1 9/2007 Llorens Miravet
2008/0000182 A1 1/2008 Pervan
2008/0000185 A1 1/2008 Duernberger
2008/0000186 A1 1/2008 Pervan et al.
2008/0000187 A1 1/2008 Pervan et al.
2008/0005998 A1 1/2008 Pervan
2008/0010931 A1 1/2008 Pervan et al.
2008/0010937 A1 1/2008 Pervan et al.
2008/0028707 A1 2/2008 Pervan
2008/0034708 A1 2/2008 Pervan
2008/0041008 A1 2/2008 Pervan
2008/0053029 A1 3/2008 Ricker
2008/0066415 A1 3/2008 Pervan
2008/0104921 A1 5/2008 Pervan et al.
2008/0110125 A1 5/2008 Pervan
2008/0134607 A1 6/2008 Pervan
2008/0134613 A1 6/2008 Pervan
2008/0134614 A1 6/2008 Pervan
2008/0155930 A1 7/2008 Pervan et al.
2008/0216434 A1 9/2008 Pervan
2008/0216920 A1 9/2008 Pervan
2008/0236088 A1 10/2008 Hannig
2008/0295432 A1 12/2008 Pervan et al.
2008/0302044 A1 12/2008 Johansson
2009/0019806 A1 1/2009 Muehlebach
2009/0064624 A1 3/2009 Sokol
2009/0100782 A1 4/2009 Groeke et al.
2009/0133353 A1 5/2009 Pervan et al.
2009/0151290 A1 6/2009 Liu
2009/0173032 A1 7/2009 Prager et al.
2009/0193741 A1 8/2009 Cappelle
2009/0193748 A1 8/2009 Boo et al.
2009/0193753 A1 8/2009 Schitter
2009/0217615 A1 9/2009 Engstrom
2009/0241460 A1 10/2009 Beaulieu
2009/0308014 A1 12/2009 Muehlebach
2010/0043333 A1 2/2010 Hannig et al.
2010/0083603 A1 4/2010 Goodwin
2010/0170189 A1 7/2010 Schulte
2010/0173122 A1 7/2010 Susnjara
2010/0281803 A1 11/2010 Cappelle
2010/0293879 A1 11/2010 Pervan et al.
2010/0300031 A1 12/2010 Pervan et al.
2010/0319290 A1 12/2010 Pervan
2010/0319291 A1 12/2010 Pervan et al.
2011/0016815 A1 1/2011 Yang
2011/0030303 A1 2/2011 Pervan et al.
2011/0041996 A1 2/2011 Pervan
2011/0047922 A1 3/2011 Fleming, III
2011/0088344 A1 4/2011 Pervan et al.
2011/0088345 A1 4/2011 Pervan
2011/0088346 A1 4/2011 Hannig
2011/0131916 A1 6/2011 Chen
2011/0154763 A1 6/2011 Bergelin et al.
2011/0167750 A1 7/2011 Pervan
2011/0167751 A1 7/2011 Engström
2011/0173914 A1 7/2011 Engström
2011/0197535 A1 8/2011 Baker et al.
2011/0225921 A1 9/2011 Schulte
2011/0225922 A1 9/2011 Pervan et al.
2011/0252733 A1 10/2011 Pervan
2011/0271632 A1 11/2011 Cappelle et al.
2011/0283650 A1 11/2011 Pervan et al.
2012/0017533 A1 1/2012 Pervan et al.
2012/0031029 A1 2/2012 Pervan et al.
2012/0036804 A1 2/2012 Pervan
2012/0042598 A1 2/2012 Vermeulen et al.
2012/0055112 A1 3/2012 Engström
2012/0124932 A1* 5/2012 Schulte ..... E04F 15/02 52/588.1
2012/0151865 A1 6/2012 Pervan et al.
2012/0174515 A1 7/2012 Pervan
2012/0174520 A1 7/2012 Pervan
2012/0174521 A1* 7/2012 Schulte ..... F16B 5/0076 52/588.1
2012/0192521 A1 8/2012 Schulte
2012/0279161 A1 11/2012 Håkansson et al.
2012/0304590 A1 12/2012 Engström
2013/0008117 A1 1/2013 Pervan
2013/0008118 A1 1/2013 Baert et al.
2013/0014463 A1 1/2013 Pervan
2013/0019555 A1 1/2013 Pervan
2013/0042562 A1 2/2013 Pervan
2013/0042563 A1 2/2013 Pervan
2013/0042564 A1 2/2013 Pervan et al.
2013/0042565 A1 2/2013 Pervan
2013/0047536 A1 2/2013 Pervan
2013/0081349 A1 4/2013 Pervan et al.
2013/0111837 A1 5/2013 Devos et al.
2013/0111845 A1 5/2013 Pervan
2013/0145708 A1 6/2013 Pervan
2013/0152500 A1 6/2013 Engström
2013/0160391 A1 6/2013 Pervan et al.
2013/0167467 A1 7/2013 Vermeulen et al.
2013/0232905 A2 9/2013 Pervan
2013/0239508 A1 9/2013 Darko et al.
2013/0263454 A1 10/2013 Boo et al.
2013/0263547 A1 10/2013 Boo
2013/0283719 A1 10/2013 Dähring et al.
2013/0318906 A1 12/2013 Pervan et al.
2014/0007539 A1 1/2014 Pervan et al.
2014/0020324 A1 1/2014 Pervan
2014/0026513 A1 1/2014 Bishop
2014/0033634 A1 2/2014 Pervan
2014/0053497 A1 2/2014 Pervan et al.
2014/0059966 A1 3/2014 Boo
2014/0069043 A1 3/2014 Pervan
2014/0090335 A1 4/2014 Pervan et al.
2014/0109501 A1 4/2014 Darko
2014/0109506 A1 4/2014 Pervan et al.
2014/0123586 A1 5/2014 Pervan et al.
2014/0130437 A1 5/2014 Cappelle
2014/0144096 A1 5/2014 Vermeulen et al.
2014/0150369 A1 6/2014 Hannig
2014/0186104 A1 7/2014 Hamberger
2014/0190112 A1 7/2014 Pervan
2014/0208677 A1 7/2014 Pervan et al.
2014/0223852 A1 8/2014 Pervan
2014/0237931 A1 8/2014 Pervan
2014/0250813 A1 9/2014 Nygren et al.
2014/0260060 A1 9/2014 Pervan et al.
2014/0290173 A1 10/2014 Hamberger
2014/0305065 A1 10/2014 Pervan
2014/0366476 A1 12/2014 Pervan
2014/0373478 A2 12/2014 Pervan et al.
2014/0373480 A1 12/2014 Pervan et al.
2015/0000221 A1 1/2015 Boo
2015/0013260 A1 1/2015 Pervan
2015/0047284 A1 2/2015 Cappelle
2015/0059281 A1 3/2015 Pervan
2015/0089896 A2 4/2015 Pervan et al.
2015/0121796 A1 5/2015 Pervan
2015/0167318 A1 6/2015 Pervan
2015/0176289 A1 6/2015 Hannig
2015/0176619 A1 6/2015 Baker
2015/0211239 A1 7/2015 Pervan
2015/0233125 A1 8/2015 Pervan et al.
2015/0267419 A1 9/2015 Darko
2015/0330088 A1 11/2015 Derelov

FOREIGN PATENT DOCUMENTS

DE 2 159 042 6/1973
DE 33 43 601 A1 6/1985

(56) References Cited

FOREIGN PATENT DOCUMENTS

| | | | |
|---|---|---|---|
| DE | 33 43 601 | C2 | 6/1985 |
| DE | 39 32 980 | A1 | 11/1991 |
| DE | 42 15 273 | A1 | 11/1993 |
| DE | 42 42 530 | A1 | 6/1994 |
| DE | 196 01 322 | A | 5/1997 |
| DE | 299 22 649 | U1 | 4/2000 |
| DE | 200 01 788 | U1 | 6/2000 |
| DE | 199 40 837 | A1 | 11/2000 |
| DE | 199 58 225 | A1 | 6/2001 |
| DE | 202 05 774 | U1 | 8/2002 |
| DE | 203 20 799 | U1 | 4/2005 |
| DE | 10 2004 055 951 | A1 | 7/2005 |
| DE | 10 2004 001 363 | A1 | 8/2005 |
| DE | 10 2005 002 297 | A1 | 8/2005 |
| DE | 10 2004 054 368 | A1 | 5/2006 |
| DE | 10 2005 024 366 | A1 | 11/2006 |
| DE | 10 2006 024 184 | A1 | 11/2007 |
| DE | 10 2006 037 614 | B3 | 12/2007 |
| DE | 10 2006 057 491 | A1 | 6/2008 |
| DE | 10 2007 018 309 | A1 | 8/2008 |
| DE | 10 2007 016 533 | A1 | 10/2008 |
| DE | 10 2007 032 885 | A1 | 1/2009 |
| DE | 10 2007 035 648 | A1 | 1/2009 |
| DE | 10 2007 049 792 | A1 | 2/2009 |
| DE | 10 2009 048 050 | B3 | 1/2011 |
| EP | 0 013 852 | A1 | 8/1980 |
| EP | 0 871 156 | A2 | 10/1998 |
| EP | 0 974 713 | A1 | 1/2000 |
| EP | 1 120 515 | A1 | 8/2001 |
| EP | 1 146 182 | A2 | 10/2001 |
| EP | 1 350 904 | A2 | 10/2003 |
| EP | 1 350 904 | A3 | 10/2003 |
| EP | 1 420 125 | A2 | 5/2004 |
| EP | 1 437 457 | A2 | 7/2004 |
| EP | 1 640 530 | A2 | 3/2006 |
| EP | 1 650 375 | A1 | 4/2006 |
| EP | 1 650 375 | A8 | 9/2006 |
| EP | 1 980 683 | A2 | 10/2008 |
| EP | 2 000 610 | A1 | 12/2008 |
| EP | 2 017 403 | A2 | 1/2009 |
| EP | 2 034 106 | A1 | 3/2009 |
| EP | 2 333 195 | A1 | 6/2011 |
| EP | 2 570 564 | A2 | 3/2013 |
| EP | 2 333 195 | B1 | 7/2014 |
| FR | 1 138 595 | | 6/1957 |
| FR | 2 256 807 | | 8/1975 |
| FR | 2 810 060 | A1 | 12/2001 |
| GB | 240629 | | 10/1925 |
| GB | 376352 | | 7/1932 |
| GB | 1171337 | | 11/1969 |
| GB | 2 051 916 | A | 1/1981 |
| JP | 03-110258 | A | 5/1991 |
| JP | 05-018028 | A | 1/1993 |
| JP | 6-146553 | A | 5/1994 |
| JP | 6-288017 | A | 10/1994 |
| JP | 6-306961 | A | 11/1994 |
| JP | 6-322848 | A | 11/1994 |
| JP | 7-300979 | A | 11/1995 |
| SE | 526 688 | C2 | 5/2005 |
| SE | 529 076 | C2 | 4/2007 |
| WO | WO 94/26999 | A1 | 11/1994 |
| WO | WO 96/23942 | A1 | 8/1996 |
| WO | WO 96/27721 | A1 | 9/1996 |
| WO | WO 97/47834 | A1 | 12/1997 |
| WO | WO 98/21428 | A1 | 5/1998 |
| WO | WO 98/22677 | A1 | 5/1998 |
| WO | WO 98/58142 | A1 | 12/1998 |
| WO | WO 99/66151 | A1 | 12/1999 |
| WO | WO 99/66152 | A1 | 12/1999 |
| WO | WO 00/20705 | A1 | 4/2000 |
| WO | WO 00/20706 | A1 | 4/2000 |
| WO | WO 00/43281 | A2 | 7/2000 |
| WO | WO 00/47841 | A1 | 8/2000 |
| WO | WO 00/55067 | A1 | 9/2000 |
| WO | WO 01/02669 | A1 | 1/2001 |
| WO | WO 01/02670 | A1 | 1/2001 |
| WO | WO 01/02671 | A1 | 1/2001 |
| WO | WO 01/02672 | A1 | 1/2001 |
| WO | WO 01/07729 | A1 | 2/2001 |
| WO | WO 01/38657 | A1 | 5/2001 |
| WO | WO 01/44669 | A2 | 6/2001 |
| WO | WO 01/44669 | A3 | 6/2001 |
| WO | WO 01/48331 | A1 | 7/2001 |
| WO | WO 01/48332 | A1 | 7/2001 |
| WO | WO 01/51732 | A1 | 7/2001 |
| WO | WO 01/51733 | A1 | 7/2001 |
| WO | WO 01/75247 | A1 | 10/2001 |
| WO | WO 01/77461 | A1 | 10/2001 |
| WO | WO 01/94721 | A1 | 12/2001 |
| WO | WO 01/94721 | A8 | 12/2001 |
| WO | WO 01/98604 | A1 | 12/2001 |
| WO | WO 02/48127 | | 6/2002 |
| WO | WO 02/055809 | A1 | 7/2002 |
| WO | WO 02/055810 | A1 | 7/2002 |
| WO | WO 02/081843 | A1 | 10/2002 |
| WO | WO 02/103135 | A1 | 12/2002 |
| WO | WO 03/012224 | A1 | 2/2003 |
| WO | WO 03/016654 | A1 | 2/2003 |
| WO | WO 03/025307 | A1 | 3/2003 |
| WO | WO 03/038210 | A1 | 5/2003 |
| WO | WO 03/044303 | A1 | 5/2003 |
| WO | WO 03/069094 | A1 | 8/2003 |
| WO | WO 03/074814 | A1 | 9/2003 |
| WO | WO 03/083234 | A1 | 10/2003 |
| WO | WO 03/087497 | A1 | 10/2003 |
| WO | WO 03/089736 | A1 | 10/2003 |
| WO | WO 2004/016877 | A1 | 2/2004 |
| WO | WO 2004/020764 | A1 | 3/2004 |
| WO | WO 2004/048716 | A1 | 6/2004 |
| WO | WO 2004/050780 | A2 | 6/2004 |
| WO | WO 2004/079128 | A1 | 9/2004 |
| WO | WO 2004/079130 | A1 | 9/2004 |
| WO | WO 2004/083557 | A1 | 9/2004 |
| WO | WO 2004/085765 | A1 | 10/2004 |
| WO | WO 2005/003488 | A1 | 1/2005 |
| WO | WO 2005/003489 | A1 | 1/2005 |
| WO | WO 2005/054599 | A1 | 6/2005 |
| WO | WO 2006/043893 | A1 | 4/2006 |
| WO | WO 2006/050928 | A1 | 5/2006 |
| WO | WO 2006/104436 | A1 | 10/2006 |
| WO | WO 2006/123988 | A1 | 11/2006 |
| WO | WO 2006/125646 | A1 | 11/2006 |
| WO | WO 2007/015669 | A2 | 2/2007 |
| WO | WO 2007/019957 | A1 | 2/2007 |
| WO | WO 2007/079845 | A1 | 7/2007 |
| WO | WO 2007/089186 | A1 | 8/2007 |
| WO | WO 2007/118352 | A1 | 10/2007 |
| WO | WO 2007/141605 | A2 | 12/2007 |
| WO | WO 2007/142589 | A1 | 12/2007 |
| WO | WO 2008/004960 | A2 | 1/2008 |
| WO | WO 2008/004960 | A8 | 1/2008 |
| WO | WO 2008/017301 | A2 | 2/2008 |
| WO | WO 2008/017301 | A3 | 2/2008 |
| WO | WO 2008/060232 | A1 | 5/2008 |
| WO | WO 2008/068245 | A1 | 6/2008 |
| WO | WO 2009/013590 | A2 | 1/2009 |
| WO | WO 2009/066153 | A2 | 5/2009 |
| WO | WO 2009/116926 | A1 | 9/2009 |
| WO | WO 2010/006684 | A2 | 1/2010 |
| WO | WO 2010/070472 | A2 | 6/2010 |
| WO | WO 2010/070605 | A2 | 6/2010 |
| WO | WO 2010/082171 | A2 | 7/2010 |
| WO | WO 2010/087752 | A1 | 8/2010 |
| WO | WO 2010/105732 | A1 | 9/2010 |
| WO | WO 2010/108980 | A1 | 9/2010 |
| WO | WO 2010/136171 | A1 | 12/2010 |
| WO | WO 2011/001326 | A2 | 1/2011 |
| WO | WO 2011/012104 | A2 | 2/2011 |
| WO | WO 2011/032540 | A2 | 3/2011 |
| WO | WO 2011/038709 | A1 | 4/2011 |
| WO | WO 2011/085788 | A1 | 7/2011 |
| WO | WO 2011/127981 | A1 | 10/2011 |
| WO | WO 2011/151758 | A2 | 12/2011 |
| WO | WO 2013/017574 | A1 | 2/2013 |

(56) References Cited

FOREIGN PATENT DOCUMENTS

| | | | |
|---|---|---|---|
| WO | WO 2013/017575 | A1 | 2/2013 |
| WO | WO 2013/025164 | A1 | 2/2013 |
| WO | WO 2013/083629 | A1 | 6/2013 |
| WO | WO 2013/087190 | A1 | 6/2013 |
| WO | WO 2013/151493 | A1 | 10/2013 |

OTHER PUBLICATIONS

U.S. Appl. No. 14/709,913, Derelov.
U.S. Appl. No. 14/730,691, Pervan.
International Search Report mailed Feb. 25, 2014 in PCT/SE2013/051374, ISA/SE Patent-och registreringsverket, Stockholm, SE, 8 pages.
Välinge Innovation AB, Technical Disclosure entitled "Mechanical locking for floor panels with a flexible bristle tongue," IP.com No. IPCOM000145262D, Jan. 12, 2007, IP.com PriorArtDatabase, 57 pages.
Engstrand, Ola (Contact)/Välinge Innovation AB, Technical Disclosure entitled "VA-038 Mechanical Locking of Floor Panels With Vertical Folding," IP com No. IPCOM000179246D, Feb. 10, 2009, IP.com Prior Art Database, 59 pages.
Engstrand, Ola (Contact)/Välinge Innovation AB, Technical Disclosure entitled "VA043 5G Linear Slide Tongue," IP com No. IPCOM000179015D, Feb. 4, 2009, IP.com Prior Art Database, 126 pages.
Engstrand, Ola (Contact)/Välinge Innovation AB, Technical Disclosure entitled "VA043b PCT Mechanical Locking of Floor Panels," IP com No. IPCOM000189420D, Nov. 9, 2009, IP.com Prior Art Database, 62 pages.
Engstrand, Ola (Contact)/Välinge Innovation AB, Technical Disclosure entitled "VA055 Mechanical locking system for floor panels," IP com No. IPCOM000206454D, Apr. 27, 2011, IP.com Prior Art Database, 25 pages.
Engstrand, Ola (Contact)/Välinge Innovation AB, Technical Disclosure entitled "VA058 Rocker Tongue," IP com No. IPCOM000203832D, Feb. 4, 2011, IP.com Prior Art Database, 22 pages.
Pervan, Darko (Author)/Välinge Flooring Technology; Technical Disclosure entitled "VA066b Glued Tongue," IP com No. IPCOM000210865D, Sep. 13, 2011, IP.com Prior Art Database, 19 pages.
Pervan, Darko (Inventor)/Välinge Flooring Technology AB, Technical Disclosure entitled "VA067 Fold Slide Loc," IP com No. IPCOM000208542D, Jul. 12, 2011, IP.com Prior Art Database, 37 pages.
Pervan, Darko (Author)/Välinge Flooring Technology; Technical Disclosure entitled "VA068 Press Lock VFT," IP com No. IPCOM000208854D, Jul. 20, 2011, IP.com Prior Art Database, 25 pages.
Pervan, Darko (Author), Technical Disclosure entitled "VA069 Combi Tongue," IP com No. IPCOM000210866D, Sep. 13, 2011, IP.com Prior Art Database, 41 pages.
Pervan, Darko (Author), Technical Disclosure entitled "VA070 Strip Part," IP com No. IPCOM000210867D, Sep. 13, 2011, IP.com Prior Art Database, 43 pages.
Pervan, Darko (Author), Technical Disclosure entitled "VA071 Pull Lock," IP com No. IPCOM000210868D, Sep. 13, 2011, IP.com Prior Art Database, 22 pages.
Pervan, Darko (Author), Technical Disclosure entitled "VA073a Zip Loc," IP com No. IPCOM000210869D, Sep. 13, 2011, IP.com Prior Art Database, 36 pages.
Laminate Flooring Tips (http://flooring.lifetips.com/cat/61734/laminate-flooring-tips-index.html). Copyright 2000. 12 pages.
Pervan, Darko, et al., U.S. Appl. No. 14/701,959 entitled "Mechanical Locking system for Floor Panels," filed in the U.S. Patent and Trademark Office on May 1, 2015.
Derelov, Peter, U.S. Appl. No. 14/709,913 entitled "Building Panel with a Mechanical Locking System," filed in the U.S. Patent and Trademark Office on May 12, 2015.
Pervan, Darko, U.S. Appl. No. 14/730,691 entitled "Mechanical Locking System for Panels and Method for Installing Same," filed in the U.S. Patent and Trademark Office on Jun. 4, 2015.
U.S. Appl. No. 14/938,612, Pervan.
U.S. Appl. No. 14/951,976, Pervan.
U.S. Appl. No. 14/962,291, Pervan, et al.
Pervan, Darko, U.S. Appl. No. 14/938,612, entitled "Mechanical Locking System for Floor Panels," filed in the U.S. Patent and Trademark Office on Nov. 11, 2015.
Pervan, Darko, U.S. Appl. No. 14/951,976, entitled "Mechanical Locking System for Floor Panels," filed in the U.S. Patent and Trademark Office on Nov. 25, 2015.
Pervan, Darko, et al., U.S. Appl. No. 14/962,291, entitled "Mechanical Locking System for Floor Panels," filed in the U.S. Patent and Trademark Office on Dec. 8, 2015.
Pervan, Darko, et al., U.S. Appl. No. 15/048,252, entitled "Mechanical Locking System for Floor Panels," filed in the U.S. Patent and Trademark Office Feb. 19, 2016.

* cited by examiner

MECHANICAL LOCKING SYSTEM FOR FLOOR PANELS

TECHNICAL FIELD

The invention generally relates to the field of mechanical locking systems for floor panels and building panels especially floor panels with mechanical locking systems, which may be locked by a vertical displacement.

FIELD OF APPLICATION OF THE INVENTION

Embodiments of the present invention are particularly suitable for use in floating floors, which are formed of floor panels which are joined mechanically with a locking system integrated with the floor panel, i.e. mounted at the factory, that are made up of one or more upper layers of veneer, decorative laminate, powder based surfaces or decorative plastic material, an intermediate core of wood fibre based material or plastic material and preferably a lower balancing layer on the rear side of the core. The following description of known technique, problems of known systems and objects and features of the invention will therefore, as a non restrictive example, be aimed at this field of application and in particular at paper based or paper free laminate flooring formed as rectangular floor panels with long and shorts sides adapted to be mechanically joined on both long and short sides. The long and short sides are mainly used to simplify the description of the invention. The panels may be squared and may have more than four sides, which are not parallel or perpendicular to each other.

It should be emphasized that embodiments of the invention may be applied to any floor panel preferably at the short edges and it may be combined with all types of known locking system on the long edges, where the floor panels are adapted to be joined using a mechanical locking system connecting the long edges in a vertical and/or horizontal direction. Embodiments of the invention may also be used for joining building panels, which preferably comprise a board material, such as wall panels, ceilings, and furniture components and similar.

BACKGROUND OF THE INVENTION

Floating floor panels such as laminate floor panels are generally joined mechanically by means of so called mechanical locking systems. These systems comprise locking means, which lock the panels horizontally and vertically on all edges.

The main advantages of floating floors with mechanical locking systems are that they are easy to install. Several versions of locking systems are use on the market and there is a continuous demand for improvements related to production costs and function.

DEFINITION OF SOME TERMS

In the following text, the visible surface of the installed floor panel is called "front side", while the opposite side of the floor panel, facing the sub floor, is called "rear side". The edge between the front and rear side is called "joint edge". By "horizontal plane (HP) or principal plane" is meant a plane, which extends parallel to the outer part of the surface layer. Immediately juxtaposed upper parts of two adjacent joint edges of two joined floor panels together define a "vertical plane (VP)" perpendicular to the horizontal plane. By "horizontally" is meant parallel to the horizontal plane and by "vertically" parallel to the vertical plane. By "up or upwardly" is meant towards the front side and by "down or downwardly" is meant towards the rear side. By "inwardly" is meant essentially horizontally towards the inner part of the panel and by "outwardly" is meant essentially horizontally and away from the inner part of the panel. By "strip panel" is meant a panel comprising a strip and a locking element. By "fold panel" is meant a panel, with a locking groove configured to cooperate with a locking element for horizontal locking that is adapted to be angled and displaced vertically during locking.

KNOWN TECHNIQUE AND PROBLEMS THEREOF

The description of the known art below is in applicable parts also used in embodiments of the invention.

For mechanical joining of long sides as well as short sides in the vertical and horizontal direction several methods and locking systems may be used. One of the most used methods is the angle-snap method and one of the most used locking systems is a system made in one piece with the core. The long sides are installed by angling. The panel is then displaced in locked position along the long side. The short sides are locked by horizontal snapping.

An alternative method is the so-called angling-angling method whereby long and short sides are locked with angling.

Recently a new and simpler method has been developed where all floor panels may be joined with just an angling of the long edges. This installation method generally referred to as "fold down" installation. An example of such a known "fold down" installation method is shown in FIGS. 18 and 19 of WO 03/016654. A problem with this method is that a flexible snap tab, arranged at an edge of a first panel, must be pressed inwardly by a sharp upper edge of an adjacent edge of a second panel.

WO 2006/043893 (Valinge Innovation AB) FIG. 13*d* describes a fold down locking system comprising a flexible tongue on the fold panel that locks against a rigid tongue formed in the edge of the adjacent strip panel. The flexible tongue has an inclined sliding surface at its outer and lower part that during folding slides against the rigid tongue and presses the flexible tongue inwardly into a sliding groove. The size of the sliding surface is limited by the thickness of the flexible tongue. This thickness is not possible to increase since such an increased thickens will also increase the thickness of the displacement groove and this will have a negative impact of the strength of the locking system.

SUMMARY OF THE INVENTION

An objective of certain embodiments of the present invention is to provide an improved mechanical locking system, which may by locked by vertical folding, comprising a flexible tongue with an outer flexible snap tab connected to an edge of a fold panel More specifically the object is to provide a vertical snap locking system, which creates less snapping resistance during locking.

The above objects of certain embodiments of the invention are achieved wholly or partly by a mechanical locking systems and floor panels, as described herein. Further embodiments of the invention are evident from the claims, description and drawings.

A first aspect of the invention comprises a set of floor panels that are mechanically connectable to each other at a first and a second edge of a first and a second floor panel respectively, wherein upper edges of said first and second edge in a connected state define a vertical plane. The first edge is provided with a protruding tongue formed in one piece with the core of the first floor panel. Said protruding tongue extends beyond the vertical plane. The second edge is provided with a separate flexible tongue comprising an inner part, which is connected to a holding groove at the second edge, and an outer flexible snap tab that extends upwardly and in the connected state into a cavity under the protruding tongue for locking the first and the second floor panel to each other in a vertical direction. The first edge comprises a strip with a locking element. The second edge comprises a locking groove, which is open towards a rear side of the second floor panel that faces a subfloor. A locking surface of the locking element is configured to cooperate, in the connected state, with a locking surface of the locking groove for locking the first and the second floor panel to each other in a horizontal direction, which is at right angles to the first and second edge. The first and the second floor panel are mechanically connectable by a vertical displacement towards each other, wherein the flexible snap tab and the protruding tongue are configured to cooperate during said displacement such that at least a part of the flexible snap tab is, in a first stage, resiliently displaced, towards the second edge, by the protruding tongue, and that the flexible snap tab is, in a second stage, displaced towards the first edge to obtain the connected state.

The invention provides the advantages that the flexible snap tab may be displaced by an inclined guiding surface located on a rather soft tongue made of the same material as the core and such displacement may be made without contact with the hard upper panel surface.

The protruding tongue is preferably arranged above the strip. The protruding tongue may be arranged at the vertical plane and extend from the vertical plane.

The separate flexible tongue with the snap tab requires a smaller holding groove as compared to the displacement groove shown in WO 2006/043893 (Valinge Innovation AB) FIG. 13*d*. The smaller holding groove makes the connection stronger since the distance between the holding groove and the locking groove may be increased.

The protruding tongue preferably comprises an inclined or rounded guiding surface at its upper and outer part.

The protruding tongue and the snap tab is preferably configured such that the initial contact, during said vertical displacement, between the protruding tongue and the snap tab is at an upper part of the snap tab. The initial contact at the upper part decreases the force needed for the displacement of the snap tab, or a part of the snap tab. The decreased force makes it easier to connect the floor panels.

There may be a space between the upper parts of the protruding tongue and the second edge.

There may be is a space between the upper part of the strip and the second edge.

The protruding tongue preferably comprises a locking surface at its lower part that is inclined and in locked position in contact with the flexible snap tab.

The locking surface of the protruding tongue is preferably arranged above the strip.

The flexible tongue may be glued into the holding groove.

The holding groove may comprise an upper wall and a lower wall and an inner wall extending between the upper and the lower wall. A glue is preferably provided at the upper, the lower and the inner wall. The flexible tongue may be glued to the upper, the lower and the inner wall.

The locking surface of the locking element and/or the locking surface of the locking groove preferably extend in an essentially vertical direction or at angle in a range of about 0 to about 45 degrees to the vertical plane.

BRIEF DESCRIPTION OF THE DRAWINGS

The present invention will by way of example be described in more detail with reference to the appended schematic drawings, which shows embodiments of the present invention.

DETAILED DESCRIPTION

To facilitate understanding, several locking systems in the figures are shown schematically. It should be emphasized that improved or different functions may be achieved using combinations of the preferred embodiments.

Figure 1:
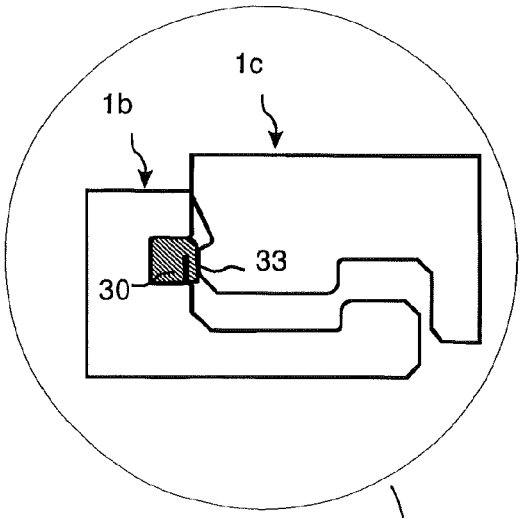
FIGS. 1-5 illustrate known systems.
Figure 2:
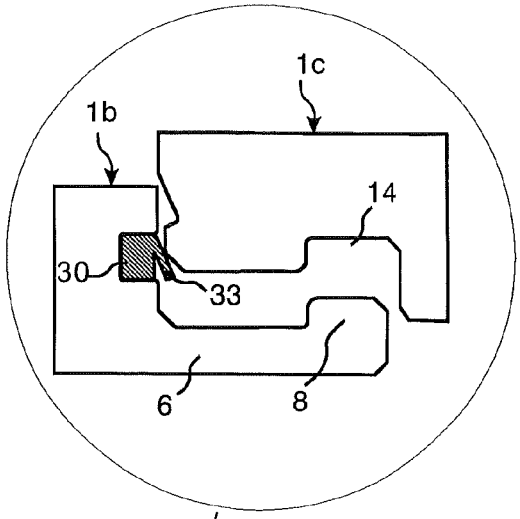
Figure 3:
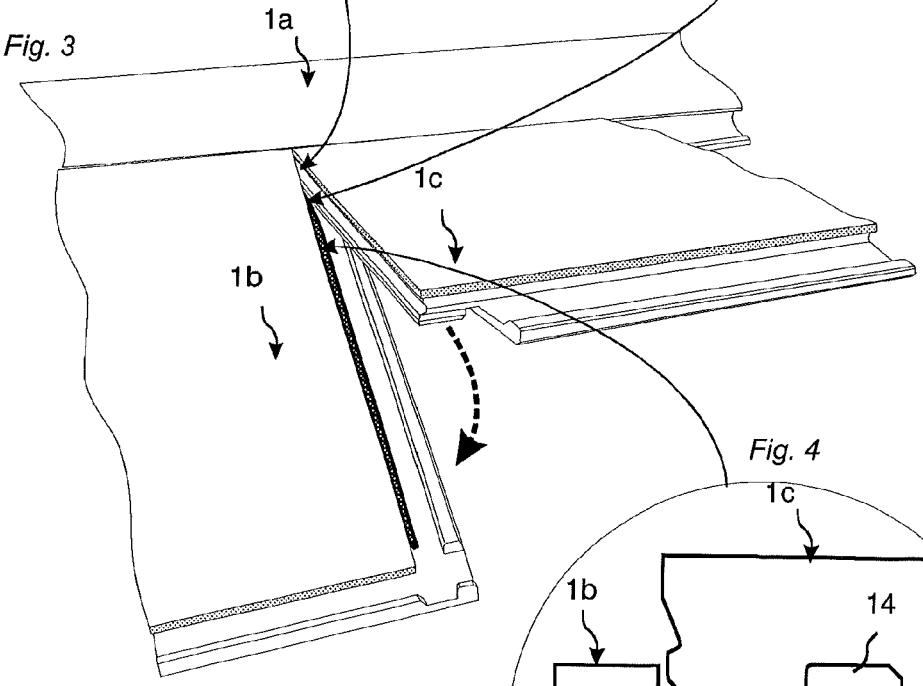
Figure 4:
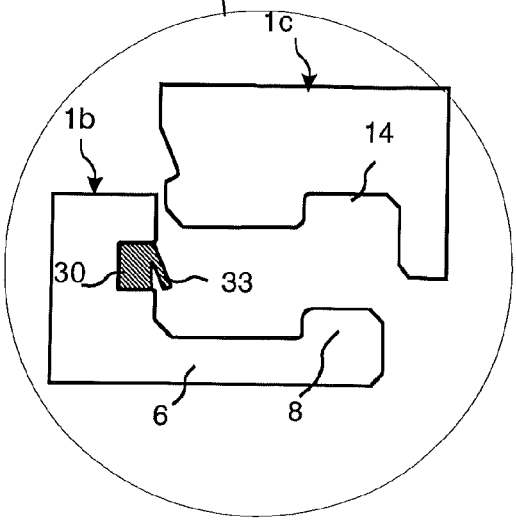

A known "fold down" installation method is described in FIGS. 1-4. Locking of short edges 1*b*, 1*c* takes place with a scissors like movement where a flexible tongue 30 is displaced inwardly gradually from one edge to the other edge when a long side of a panel 1*c* in one row is connected by angling to an adjacent panel 1*a* in a previously installed row. A flexible snap tab 33, which in most cases is made of a plastic section, is during folding bended horizontally along the joint. A part of the snap tab is during folding pressed inwardly, as shown in FIG. 1, and other parts are in contact with the adjacent edge, FIG. 2, or in an completely unlocked position, as shown in FIG. 4. The horizontal locking takes place when a locking element 8 located on a strip 6 on a first panel 1*b*, hereafter referred to as strip panel, cooperates with an adjacent second panel 1*c*, hereafter referred to as fold panel, such that the locking element 8 is inserted into a locking groove 14.

Figure 5A:
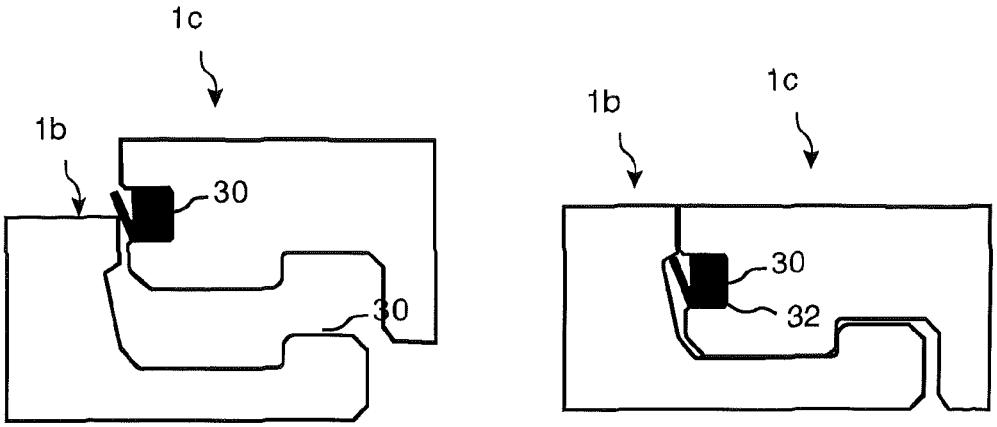
Figure 5B:
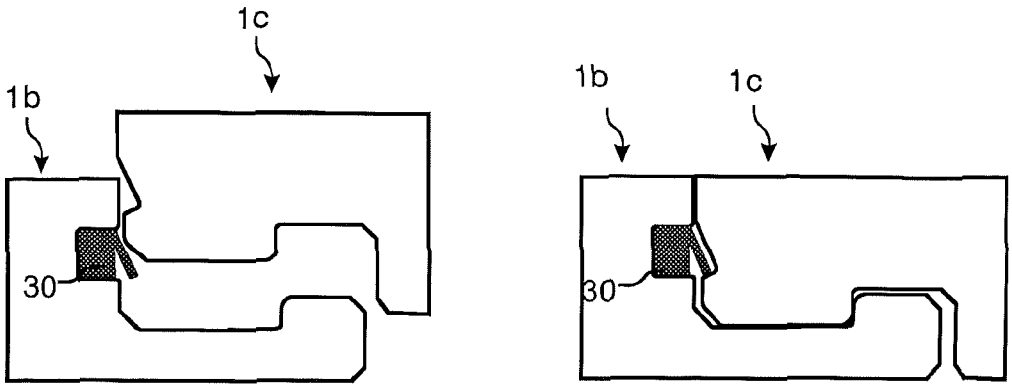

FIGS. 5*a* and 5*b* show that the flexible tongue 30 may be connected to an edge of the fold panel 1*c* or the strip panel strip panel 1*b*.

From a production perspective it is an advantage if the flexible tongue 30 is connected to a fold panel 1*c* because it is easy to insert such a flexible tongue into a holding groove 32. There is no protruding strip 6 and the insertion of the flexible tonged may be made with an inserting equipment comprising rather simple guiding devices that guide the tongue into the holding groove 32. A problem with such a flexible tongue 30, as shown in FIG. 5*a*, is that the locking system is difficult to lock since the snap tab must be pressed inwardly by a sharp upper edge.

Figure 6A:
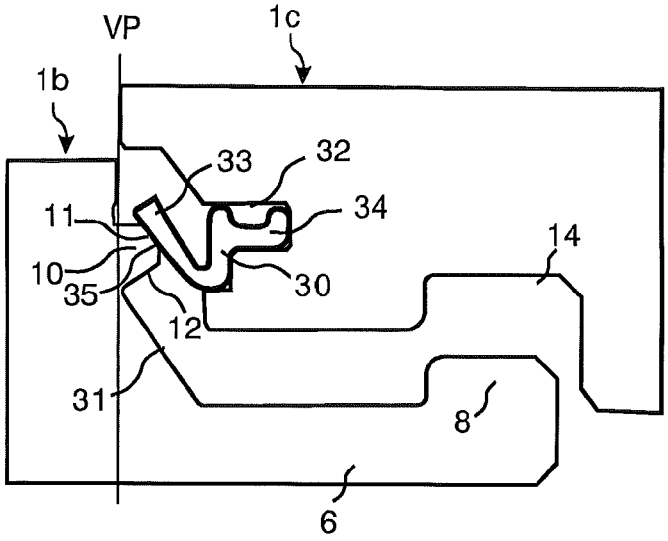
FIGS. 6*a*-*c* illustrate a first embodiment of the invention.
Figure 6B:
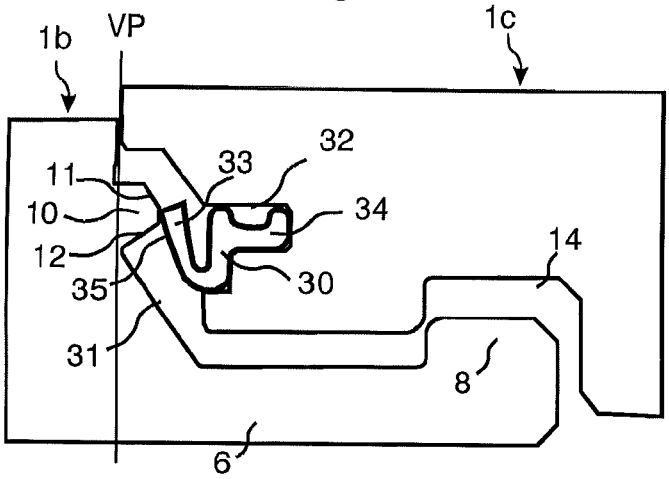
Figure 6C:
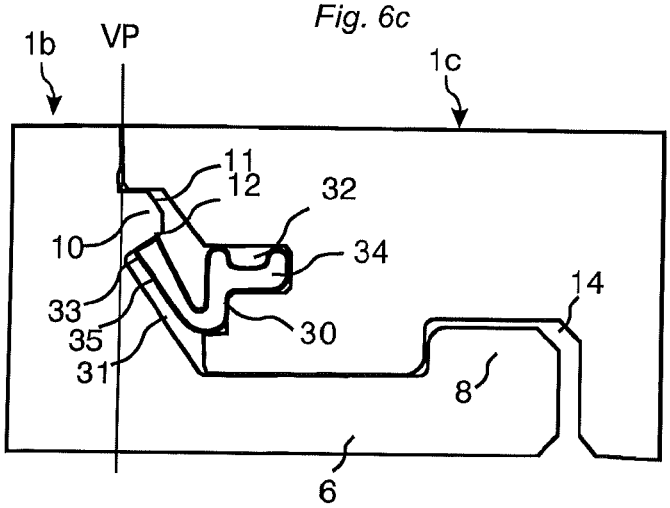

FIGS. 6*a*-6*c* show an embodiment of the invention. A strip panel 1*b* comprising a strip 6 and a locking element 8 which cooperates with a locking groove 14 in a fold panel 1*c* for horizontal locking of two adjacent edges of the fold panel 1*c* and the strip panel 1*b* is provided. The strip panel comprises a protruding tongue 10 with an upper inclined or rounded guiding surface 11 and a lower locking surface 12. The fold panel 1*c* comprises a flexible tongue 30 in a holding groove 32, which is open towards the vertical plane VP. The flexible tongue 30 has an inner part 34 connected into the holding groove 32 and a flexible snap tab 33 with a sliding surface 35 extending outwardly and upwardly. The sliding surface 35, that preferably is located at an upper part of the flexible snap tab, cooperates with the guiding surface 11 during a vertical displacement of the fold panel 6*c* and causes a pressure force that bends the flexible snap tab 33 inwardly towards the holding groove 32 as shown in FIGS. 6*a*-6*b*. The snap tab 33 snaps back toward its initial position and into the cavity 31 when the edges 1*b*, 1*c* are aligned horizontally and the lower locking surface 12 on the lower part of the protruding tongue 10 locks against the upper part of the snap tab 33 as shown in FIG. 6*c*. The flexible snap tab 33 and the protruding tongue 10 lock the edges vertically parallel to the vertical plane VP. The locking element 8 and the locking groove 14 lock the edges in a horizontal direction perpendicular to the vertical plane VP. The strip 6 and the protruding tongue 10 form a cavity 31 that in connected state accommodates an outer part of the flexible snap tab 33. The protruding tongue is preferably arranged above the strip, at the vertical plane and extends from the vertical plane. The locking surface of the protruding tongue is preferably arranged above the strip.

The inclined guiding surface 11 facilitates an easy locking since the flexible snap may not be in contact during locking with the upper sharp edge of the panel surface. The guiding surface may be used to facilitate an easy locking even in the case that a contact may exist during folding between the upper edge and the flexible snap tab 11.

The lower locking surface 12 may be inclined and the locking may be made with a pre tension such that the snap tab 11 in locked position is pressed against a lower part of the protruding tongue 10.

Figure 7A:
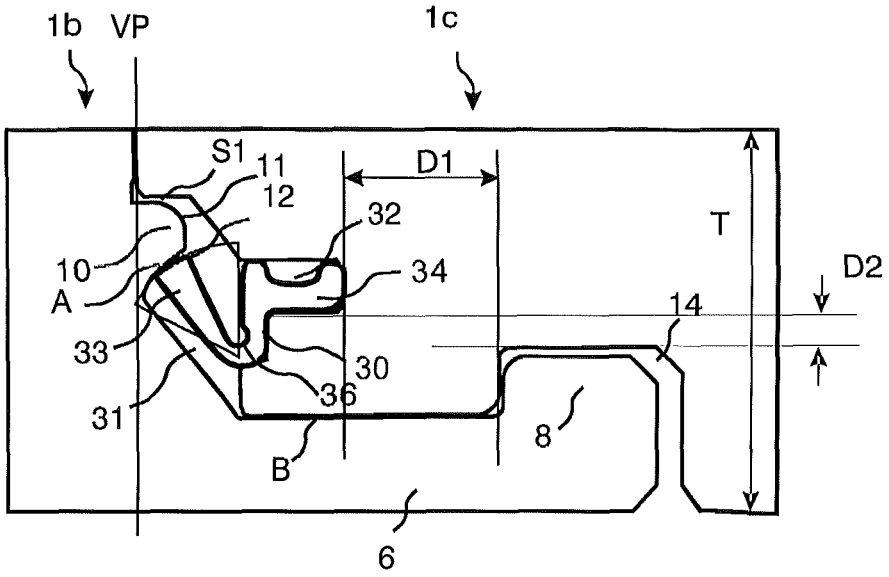
FIGS. 7*a*-*b* illustrate a second embodiment of the invention.

FIG. 7*a* shows that there may be a space S1 between the upper part of the tongue 10 and the adjacent panel edge. The vertical locking is accomplished with an upper contact point A between the protruding tongue 10 and the flexible snap tab 33, and a lower contact point B between the strip 6 and a lower edge of the fold panel 1*c*. The snap tab may be flexible or rigid depending on the design and material composition. Polymer materials are preferred and the flexible tongue may comprise several different materials in for example the inner part or in the snap tab. The flexible tongue 30 may comprise a knee joint 36 with increased flexibility that facilitates bending and/or displacement of the snap tab. The locking groove 14 and the holding groove 32 are preferably horizontally displaced, in order to obtain a strong locking system, and preferably with a distance D1 that is at least about 30% of the floor thickness T. The upper part of the locking groove 14 and the inner part of the holding groove 32 are preferably also displaced vertically with a distance D2.

Figure 7B:
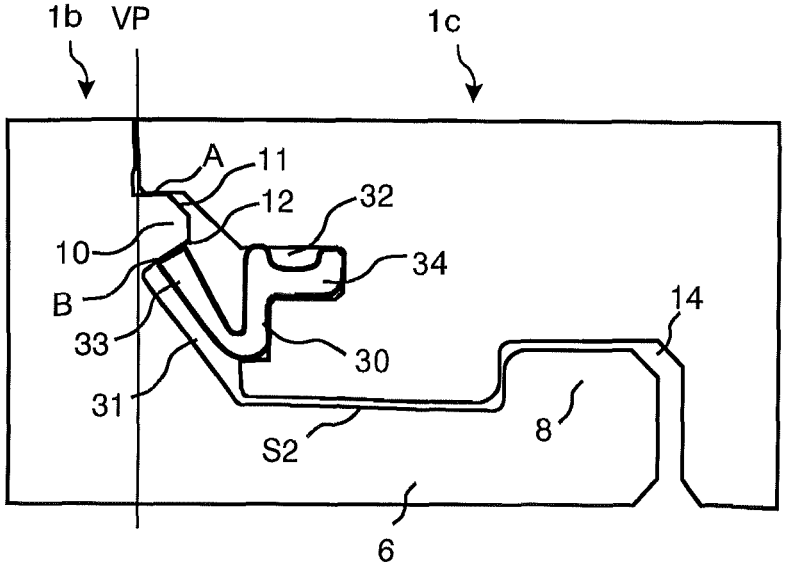

FIG. 7*b* shows that there may be a space S2 between the upper part of the strip 6 and the lower edge of the adjacent fold panel 1*c*. The vertical locking is in this embodiment accomplished with a lower contact point B between the protruding tongue 10 and the flexible snap tab 33, and an upper contact point A between the protruding tongue 10 and an upper part of the fold panel 1*c* that overlaps the protruding tongue.

Figure 8A:
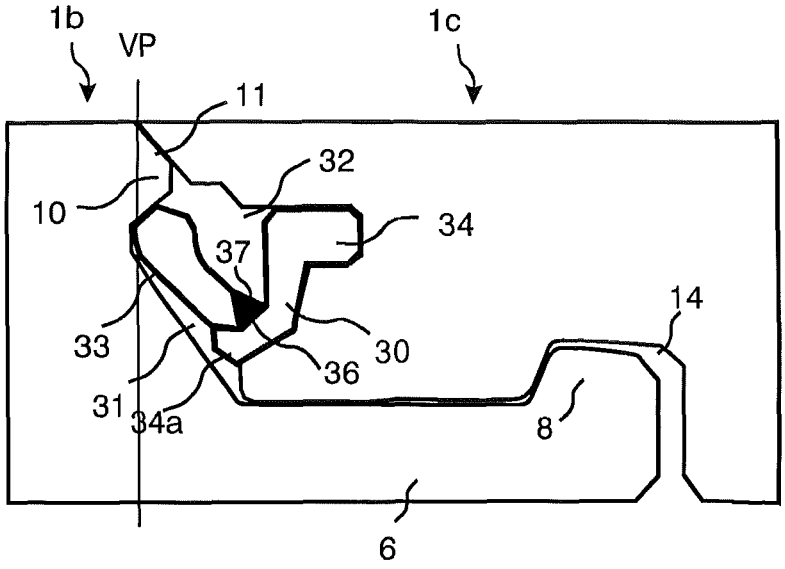
FIGS. 8*a*-*b* illustrate a third embodiment of the invention.

FIG. 8*a* shows an embodiment where the upper edges of the panels are in contact with each other and the guiding surface 11 extends downwardly from the panel surface. The knee joint 36 comprises a flexible material 37 that is softer than the inner part 34 and the snap tab 33. The flexible tongue 30 comprises an inner part 34 that comprises a lower part 34*a* located under the flexible snap tab 33.

Figure 8B:
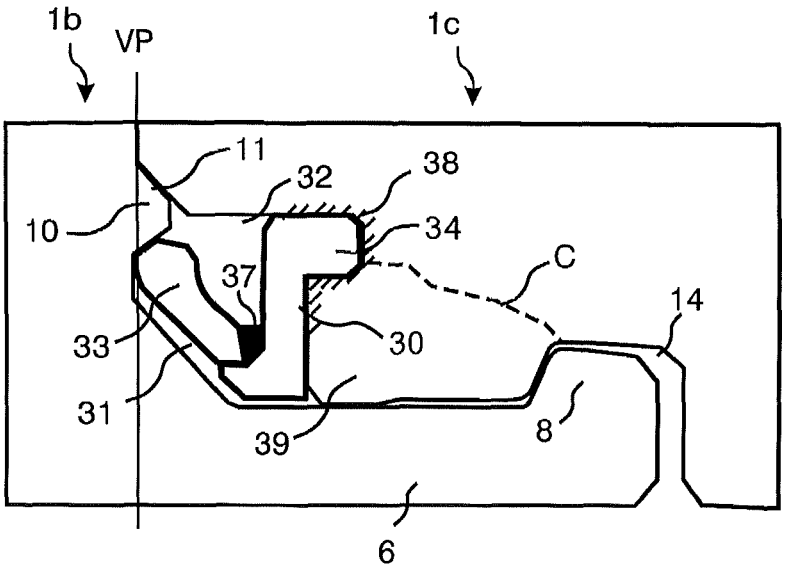

FIG. 8*b* shows an embodiment where the holding groove 32 comprises glue 38 and the flexible tongue 30 is glued into the holding groove. This gives a stronger locking system and cracks C extending primarily between the holding groove 32 and the locking groove 14 may be avoided. The lowest part of the flexible tongue 30 may be located essentially on the same horizontal plane as the lower and outer part 39 of the fold panel 1*c*. The holding groove may comprise an upper wall and a lower wall and an inner wall extending between the upper and the lower wall. The glue is preferably provided at the upper, the lower and the inner wall. The flexible tongue is preferably glued to the upper, the lower and the inner wall.

The invention claimed is:

1. A set of floor panels which are mechanically connectable to each other at a first edge and a second edge of a first floor panel and a second floor panel, respectively, wherein an upper end of said first edge and an upper end of said second edge in a connected state of the floor panels define a vertical plane, wherein the first edge is provided with a protruding tongue formed in one piece with a core of the first floor panel, said protruding tongue extends beyond the vertical plane, the second edge is provided with a separate flexible tongue, the flexible tongue comprises an inner part, which is connected to a holding groove at the second edge, and an outer flexible snap tab that extends upwardly in the connected state into a cavity under the protruding tongue for locking the first floor panel and the second floor panel to each other in a vertical direction, the first edge comprises a strip with a locking element that is provided farther beyond the vertical plane than the protruding tongue, the second edge comprises a locking groove, which is open towards a rear side of the second floor panel that faces a subfloor, a locking surface of the locking element is configured to cooperate, in the connected state, with a locking surface of the locking groove for locking the first floor panel and the second floor panel to each other in a horizontal direction, which is at a right angle to the first edge and the second edge, wherein the first floor panel and the second floor panel are mechanically connectable by a vertical displacement towards each other, wherein the flexible snap tab and the protruding tongue are configured to cooperate during said displacement such that at least a part of the flexible snap tab is, when the first floor panel and the second floor panel are vertically displaced towards each other, in a position, resiliently displaced towards the second edge by the protruding tongue, and that the flexible snap tab is, when the first floor panel and the second floor panel are in the connected state, displaced towards the first edge.

2. The set of floor panels as claimed in claim 1, wherein an outer part of the protruding tongue comprises an inclined or rounded guiding surface at an upper and outer part of the protruding tongue.

3. The set of floor panels as claimed in claim 1, wherein the protruding tongue is arranged above the strip.

4. The set of floor panels as claimed in claim 1, wherein the protruding tongue is arranged at the vertical plane and extends from the vertical plane.

5. The set of floor panels as claimed in claim 1, wherein a space is provided between upper parts of the protruding tongue and the second edge.

6. The set of floor panels as claimed in claim 1, wherein a space is provided between an upper part of the strip and the second edge.

7. The set of floor panels as claimed in claim 1, wherein the protruding tongue comprises at a lower part of the protruding tongue a locking surface which in the connected state is configured to cooperate with the flexible snap tab.

8. The set of floor panels as claimed in claim 7, wherein the locking surface of the lower part of the protruding tongue is inclined.

9. The set of floor panels as claimed in claim 7, wherein the locking surface of the lower part of the protruding tongue is arranged above the strip.

10. The set of floor panels as claimed in claim 1, wherein the protruding tongue and the flexible snap tab is configured such that the initial contact, during said vertical displacement, between the protruding tongue and the flexible snap tab is at an upper part of the flexible snap tab.

11. The set of floor panels as claimed in claim 1, wherein the flexible tongue is glued into the holding groove.

12. The set of floor panels as claimed in claim 1, wherein the holding groove comprise an upper wall and a lower wall and an inner wall extending between the upper wall and the lower wall.

13. The set of floor panels as claimed in claim 12, wherein a glue is provided at the upper wall, the lower wall and the inner wall.

14. The set of floor panels as claimed in claim 12, wherein the flexible tongue is glued to the upper wall, the lower wall and the inner wall.

15. The set of floor panels as claimed in claim 2, wherein the protruding tongue is arranged above the strip.

16. The set of floor panels as claimed in claim 8, wherein the locking surface of the lower part of the protruding tongue is arranged above the strip.

17. The set of floor panels as claimed in claim 13, wherein the flexible tongue is glued to the upper wall, the lower wall and the inner wall.

18. The set of floor panels as claimed in claim 1, wherein the second edge is provided with a secondary groove below the holding groove, and a portion of the flexible tongue is provided in the secondary groove.

* * * * *